United States Patent [19]

Ittner et al.

[11] 4,411,381

[45] Oct. 25, 1983

[54] HONEYCOMB MANUFACTURING METHOD

[75] Inventors: Nelson C. Ittner, P.O. Box 1266, Blue Jay, Calif. 92317; Gary N. Ittner, Los Angeles, Calif.

[73] Assignee: Nelson C. Ittner, Los Angeles, Calif.

[21] Appl. No.: 364,808

[22] Filed: Apr. 2, 1982

[51] Int. Cl.[3] ..... B32B 3/12

[52] U.S. Cl. ..... 228/181; 72/137; 228/173 D; 428/116; 428/593

[58] Field of Search ..... 72/136, 137; 228/157, 228/181, 173 D; 29/455 LM; 428/116, 118, 593, 595

[56] References Cited

U.S. PATENT DOCUMENTS

| | | | |
|---|---|---|---|
| 2,668,327 | 2/1954 | Steele | 428/116 X |
| 3,086,624 | 4/1963 | Wyatt | 428/595 X |
| 3,196,533 | 7/1965 | Ida et al. | 428/116 X |

*Primary Examiner*—Henry F. Epstein

*Attorney, Agent, or Firm*—Ralph B. Pastoriza

[57] ABSTRACT

When conventional honeycomb structures are formed into cylinders, the inner wall made up of the inner edges of the individual honeycombs is circumferentially compressed and the outer wall made up of the outer edges of the honeycombs is circumferentially stretched. As a result, the height of the inner wall increases and the height of the outer wall decreases resulting in a bowing in of the central portion of the cylinder so that the cylinder assumes an hourglass shape. This bowing in can be avoided by corrugating the original ribbon core material in the manufacture of the honeycomb in such a manner that one longitudinal edge of the corrugated ribbon follows a wave form of an amplitude greater than the wave form defining the opposite longitudinal edge. When such formed ribbons are stacked and curved to form a cylindrical structure, the one longitudinal edges will be stretched and the opposite longitudinal edges with be compressed, resulting in an equalizing of the amplitudes of the respective wave forms defining these edges so that the lateral wall of the resulting cylindrical structure in a direction parallel to the axis of the cylinder is rectilinear.

4 Claims, 12 Drawing Figures

HONEYCOMB MANUFACTURING METHOD

FIELD OF THE INVENTION

This invention relates generally to honeycomb structures and more particularly to an improved honeycomb manufacturing method and resulting honeycomb product.

BACKGROUND OF THE INVENTION

Conventional honeycomb structures are usually formed by corrugating a ribbon of core material such that the opposite longitudinal edges define truncated triangular wave forms when viewed from the respective sides. Thus, there is a rising section, a horizontal section, a declining section and another horizontal section and then the pattern is repeated.

When successive ribbons are placed one on top of the other, there are defined six sided honeycombs, the lower horizontal portions of one ribbon engaging the upper horizontal portions of the ribbon beneath it, these engaging portions being termed the "nodes" of the honeycomb structure. The nodes themselves are welded together with brazing material so that a fairly large sheet of the honeycomb structural material can be provided and will hold together.

Panels may be provided on either side of the honeycomb sheet formed as above and brazed thereto so that a honeycomb panel results. In other instances, a honeycomb structure may be curved into a cylindrical shape or collar shape and an outer panel or skin only applied to the exterior. Such cylindrical shaped honeycomb structures are used widely in the aircraft industry since they provide a very high strength-to-weight ratio.

When a sheet or large area of honeycomb structural material is curved into a cylindrical shape, the one side which will constitute the outer wall of the cylinder is stretched while the opposite side constituting the inner wall of the cyliner is compressed. Thus, the truncated triangular wave forms followed by the opposite longitudinal edges are in turn respectively stretched and compressed. This action results in a change in the height of the truncated triangular wave form, the stretched longitudinal edges resulting in a decrease in the overall height of the wave form, while compression of a longitudinal edge increases the height of the wave form.

As a consequence of the foregoing action, the inner wall of the cylinder will have a height that is greater than the outer wall of the cylinder so that the entire cylinder is distorted into an hourglass-shape; that is, the central portion of the cylinder tends to bow inwardly.

While this bowing or deformation is slight, particularly in the case of large radii cylinders, in an attempt to provide for a straight cylindrical construction, strains are placed on the individual honeycomb cells and as a consequence some of the welded nodes can fail. Also, where an outer skin has been attached, the described deformation can result in failure of various weld points of the outer skin to the honeycomb structure.

BRIEF DESCRIPTION OF THE PRESENT INVENTION

With the foregoing in mind, the present invention contemplates an improved honeycomb manufacturing method and resulting product wherein cylindrical structures of honeycomb material can be formed without the heretofore described disadvantage of strains being developed in the nodes and between the edges and surrounding skin as a consequence of the tendency for the cylindrical shape to bow inwardly or assume an hourglass configuration.

More particularly, in accord with the method of this invention, a ribbon of honeycomb core material is initially corrugated such that one longitudinal edge defines a first repetitive wave form of a first amplitude when viewing the ribbon when straight from one side and the opposite longitudinal edge defines a second repetitive wave form of a second amplitude, less than said first amplitude, when viewing the ribbon when straight from the opposite side. These repetitive wave forms may take the form of truncated triangles, wherein the degree of truncation is different to provide for the different referred to amplitudes.

With the foregoing formation of the ribbon of core material, when the corrugated ribbons are stacked and curved in a manner to stretch the one side and compress the opposite side, the referred to first and second amplitudes can be equalized for a given radius of curvature. As a consequence, when such curved ribbons are stacked to form a cylindrical honeycomb structure, the lateral wall in a direction parallel to the axis of the cylindrical structure is always rectilinear; that is, there is no bowing either inwardly or outwardly. Further, the planes of the nodes after the referred to amplitudes are equalized will be normal to the axis of the cylindrical structure. As a result, no strains are developed at the nodes or with respect to an attached outer skin.

Suitable brazing inserts may be provided during the formation of the cylindrical honeycomb structure so that the entire structure can be welded with the brazing material inserts in place.

BRIEF DESCRIPTION OF THE DRAWINGS

A better understanding of this invention as well as further features and advantages thereof will be had by now referring to the accompanying drawings in which.

DETAILED DESCRIPTION OF THE INVENTION

Figure 1:
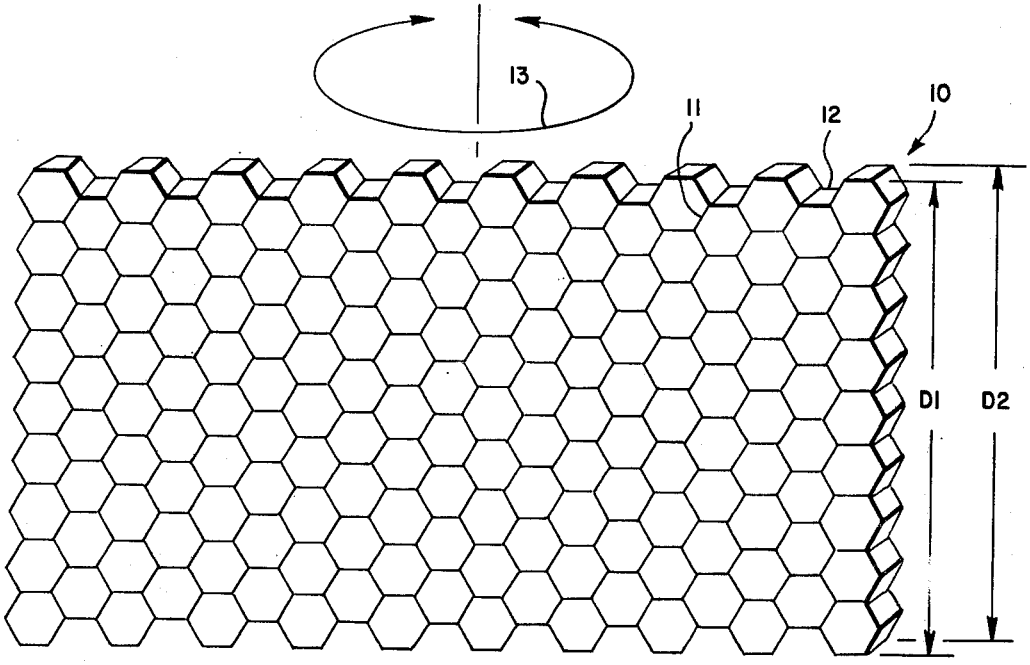
PRIOR ART FIG. 1
FIG. 1 is a broken away perspective view of a typical prior art honeycomb structure.

Referring first to FIG. 1, there is shown a typical prior art honeycomb structure 10 made up of individual six-sided cells. The front edges of these cells as viewed in FIG. 1 make up a front wall 11 and the rear edges make up a rear wall 12. The overall height of the structure as measured vertically along its front wall is indicated at D1 while the overall height of the structure as measured along a rear wall in a vertical direction is D2. Since the six-sided honeycomb cells are uniform throughout their thickness, the height D1 equals the height D2.

The honeycomb structure of FIG. 1 is completed by the provision of a panel 13 covering the front wall or surface as shown.

Figure 2:
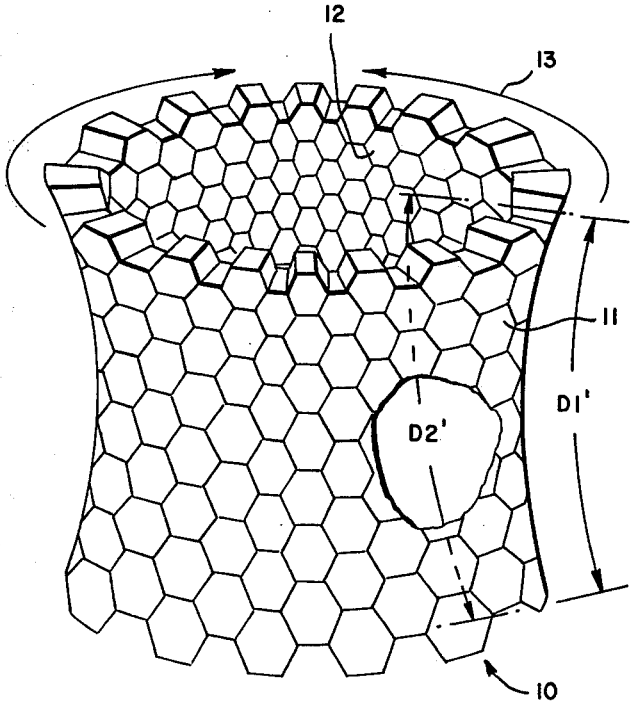
PRIOR ART FIG. 2
FIG. 2 is a perspective view, partly broken away of the prior art structure of FIG. 1 formed into a cylindrical collar.

If the structure of FIG. 1 is now curved into a cylindrical shape as by folding the opposite ends in the direction of the circular arrow 13, the resulting structure will be as appears in FIG. 2.

Referring specifically to FIG. 2, it will be noted that the structure does not form a true cylinder but rather assumes an hourglass shape; that is, the central portion of the cylinder is bowed inwardly.

This configuration is a result of the fact that during folding of the honeycomb structure of FIG. 1 into a cylindrical shape, the edges of the honeycomb defining the front wall 11 are circumferentially stretched while the edges of the honeycomb defining the rear wall 12 are circumferentially compressed. The stretching action results in a decrease of the overall height D1 of FIG. 1 while the compression results in an increase in the overall height D2 of FIG. 1.

These changed height dimensions are indicated at D1′ and D2′ in FIG. 2 respectively. Since D2′ is greater than D1′, the distortion into an hourglass configuration results.

Efforts to force the cylinder or collar structure of FIG. 2 into a straight cylinder wherein the lateral wall as measured in a vertical direction is exactly parallel to the axis of the cylinder and is rectilinear can result in the of stresses and strains at the various welded nodal points of the cells.

Figure 3:
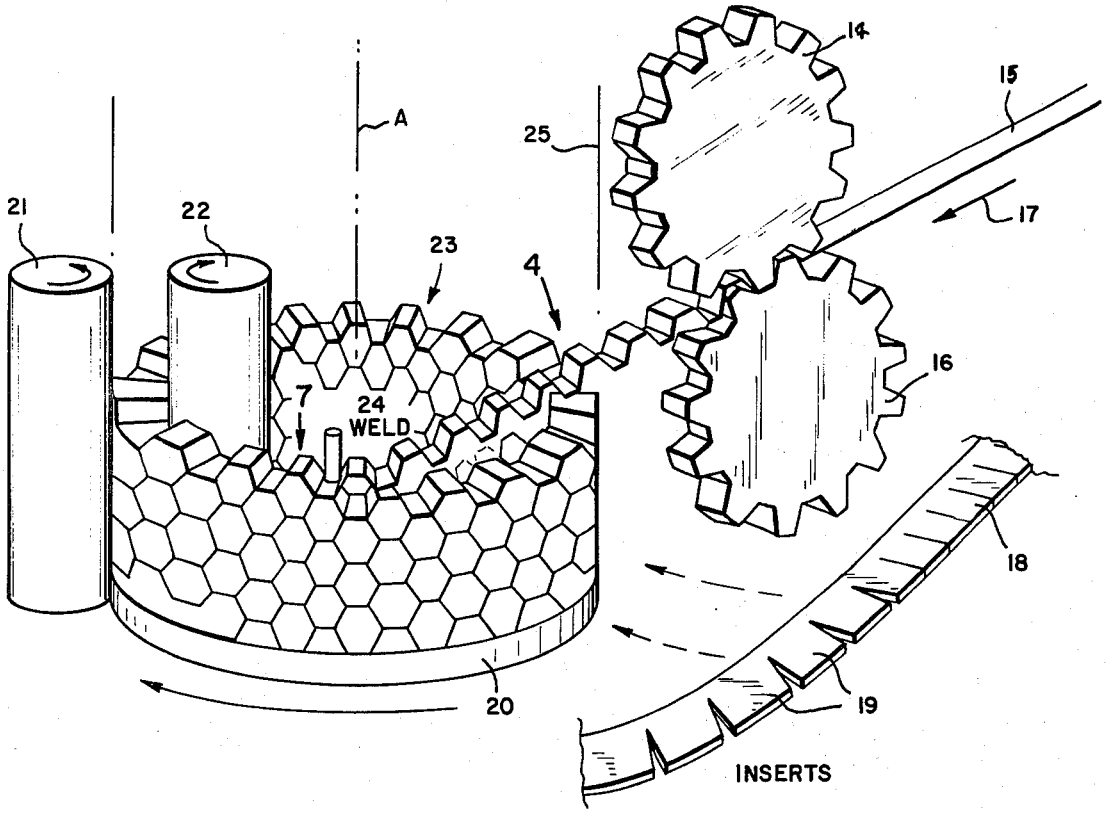
FIG. 3 is a perspective view highly diagramatic in form illustrating the method of forming a honeycomb structure in the form of a cylinder in accord with the present invention wherein the problems associated with the structures of FIGS. 1 and 2 are avoided.

Referring now to FIG. 3, there will be described the improved method and product of this invention wherein the above-noted problems are overcome.

In the upper right hand portion of FIG. 3 there is schematically depicted at 1 a ribbon of honeycomb core material shown passing corrugation rollers 14 and 16, along a straight path designated generally by the numeral 17. Corrugation rollers 14 and 16 will corrugate the ribbon 15 in such a manner that one longitudinal edge defines a first repetitive wave form of a first amplitude when viewing the ribbon from one side and the opposite longitudinal edge defines a second repetitive wave form of a second amplitude, less than the first amplitude, when viewing the ribbon from the opposite side. As will become clearer as the description proceeds, these repetitive wave forms constitute truncated triangles.

A strip of brazing material 18 has transverse cuts formed therein, such that when the strip is curved in its own plane, individual inserts 19 will be defined. The corrugated ribbon itself is laid down on a circular platform 20 which is caused to rotate and cooperates with counter-rotating vertical guide rollers 21 and 22 to guide the path of movement of the core material. The brazing inserts are positioned between opposing nodes of the corrugated ribbon as it is being formed into the helical stack, the ribbon 18 with inserts 19 being positioned inside the stack to feed the inserts in place as indicated by the dashed arrows.

With the individual inserts between the nodes, welding of the opposed nodes of the successive turns of the helical stack will take place, as indicated schematically at 24.

Because of the manner of corrugating the ribbon as briefly described, a lateral wall of the resulting cylindrical structure in a vertical direction parallel to the axis A of the cylinder will be rectilinear as indicated by the dashed vertical line 25; that is, there will be no bowing inwardly of the resulting cylindrical structure as characterized the prior art discussed in FIGS. 1 and 2. As a result, the planes of the nodes will be normal to the axis A.

Referring now to FIGS. 4 through 9, the manner in which the ribbon core is corrugated to accomplish the foregoing will be better understood.

Figure 4:
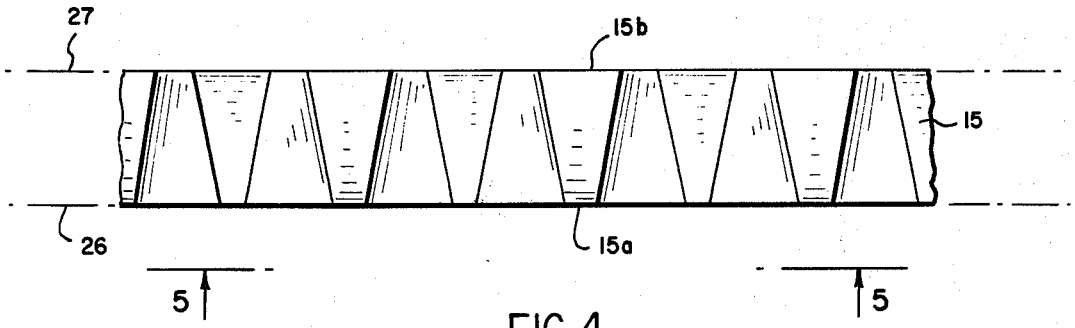
FIG. 4 is a fragmentary top plan view of a ribbon of honeycomb core material in a straight configuration after being corrugated, looking generally in the direction of the arrow 4 of FIG. 3.
Figure 5:
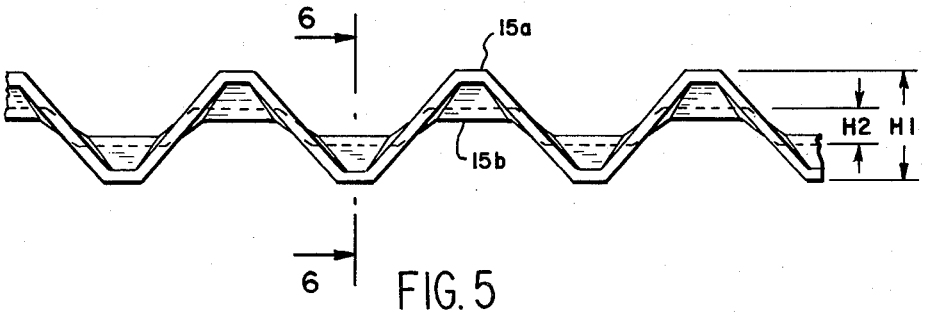
FIG. 5 is a side elevational view of one longitudinal edge of the ribbon core looking in the direction of the arrows 5—5 of FIG. 4.

Referring first to FIG. 4, there is shown the corrugated strip of FIG. 3 looking in the direction of the arrow 4. FIG. 5 shows the core of FIG. 4, looking in the direction of the arrows 5—5. In the following discussion, FIGS. 4 and 5 should be referred to together.

As shown, the resulting corrugation by the rollers 16 and 17 of FIG. 3 results in one longitudinal edge 15*a* of the ribbon 15 defining a first truncated triangular wave form when viewing the ribbon from one side, such as is viewed in FIG. 5.

The opposite longitudinal edge 15*b*, in turn, defines a second truncated triangular wave form when viewing the ribbon from the opposite side. This second truncated triangular wave form can be visualized from the view of FIG. 5 looking to the far edge of the structure designated 15*b*.

The two sides along which the longitudinal edges lie when viewed in FIG. 4 are designated 26 and 27 and are shown as extending in straight lines. When the one and opposite longitudinal edges of the ribbon of core material are viewed as described from these opposite sides, the height of the truncated triangular wave form defining the one longitudinal edge 15*a* will be greater than the height of the truncated triangular wave form defining the opposite longitudinal edge 15*b*. These respective heights are shown at H1 for the longitudinal edge 15*a* and H2 for the opposite longitudinal edge 15*b*.

Figure 6:
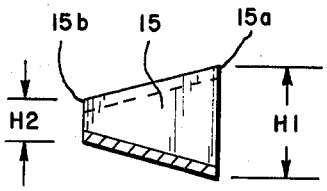
FIG. 6 is a cross section taken in the direction of the arrow 6—6 of FIG. 5.

The heights H1 and H2 are also evident from the cross section shown in FIG. 6.

As a result of the foregoing dissymmetry between the one and opposite longitudinal edges, when the corrugated ribbon core is curved into the cylindrical configuration described in FIG. 3 the resulting stretching and compression of the one and opposite sides respectively equalizes the heights H1 and H2 so that a perfectly straight cylindrical configuration will result.

Figure 7:
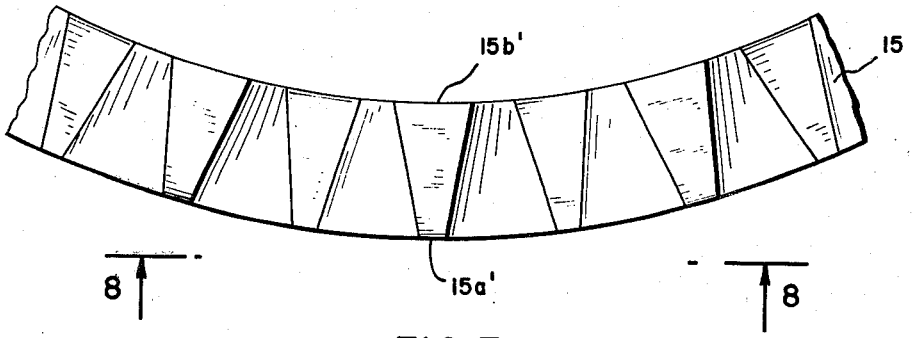
FIG. 7 is another plan view of the corrugated ribbon of FIG. 4 as it would appear after being deformed into a curved configuration.
Figure 8:
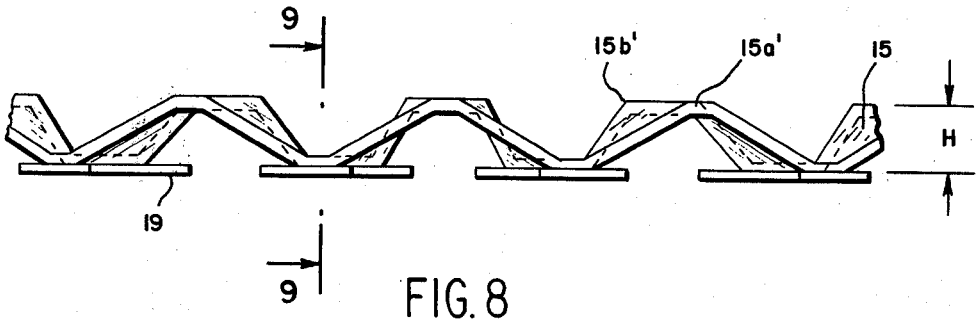
FIG. 8 is a side elevational view of one longitudinal edge of the core of FIG. 7 taken in the direction of the arrows 8—8.
Figure 9:
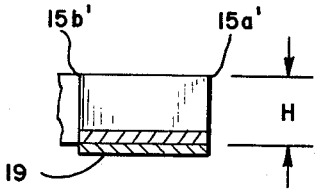
FIG. 9 is a cross section of the ribbon core looking in the direction of the arrows 9—9 of FIG. 8.

The foregoing can best be understood by referring now to the plan view of FIG. 7 which is the same as the plan view of FIG. 4, but shows the corrugated ribbon core curved. The portion of the ribbon shown in FIG. 7 corresponds to the way it would appear when looking in the direction of the arrow 7 of FIG. 3 wherein the portion has been curved to conform to the cylindrical shape.

It will be evident from FIG. 7 that the longitudinal edge now designated 15*a*′ along the front of the ribbon has been stretched while the opposite longitudinal edge now designated 15*b*′ is compressed. If the respective radii of curvatures are carefully chosen, the stretching and compression will be sufficient to decrease the height H1 and increase the height H2 by appropriate amounts, until these heights are equalized or the same. The new equal heights are designated H in the view of FIG. 8 which shows the manner in which the strip of FIG. 7 would appear when looking front on in the direction of the arrows 8—8.

FIG. 9 again illustrates the equality of the heights of the one side or longitudinal edge and the opposite side or longitudinl edge as shown at 15*a*′ and 15*b*′.

It will be understood that the shorter the radius of the resulting collar or cylinder; that is, the more curvature that is desired, the greater will have to be the differences in the degree of truncation of the triangular wave forms defining the opposite sides or longitudinal edges of the ribbon. In an extreme case, one edge might not be truncated at all, so that a triangular wave form results while the opposite longitudinal edge is severely truncated so as to be almost flat. When distorted into a curve, the heights can again then be made substantially equal but the radius will be quite short or tight.

Where the wave form is defined as a "truncated triangular wave form," the term "truncated" is meant to include various different degrees of truncation as well as the extreme limit, wherein the truncation line approaches zero so that a triangle results.

It should also be understood from the previous discussion and the illustrations in the various drawings, that dimensions have been greatly exaggerated for purposes of clarity. In actual practice, the radius of curvature of the cylinder being formed might be of the order of feet whereas the diameters of the individual honeycomb cells are in the order of fractions of an inch. Thus, the actual differences in the wave forms on the opposite sides need only be slight to assure that a perfect cylindrical configuration will result.

With respect to the foregoing, it should be understood that the sloping outlines of the top and bottom surfaces as shown in the plan view of FIG. 4 would appear to be almost parallel lines where the actual difference in the wave forms on the opposite sides is very slight, thus preserving the hexagonal honeycomb configuration. Where the radius of curvature is relatively small, the honeycomb structure can still be preserved by tolerating a "drawing" of the material when it is curved into the cylindrical configuration. This "drawing" of the material will not be sufficient to cause any problems with separation of the welded nodes as a consequence of developed strains, but will operate in cooperation with the slightly different front and rear wave forms to assure a cylindrical configuration with rectilinear lateral sides; that is, an absence of any hourglass configuration.

Figure 10:
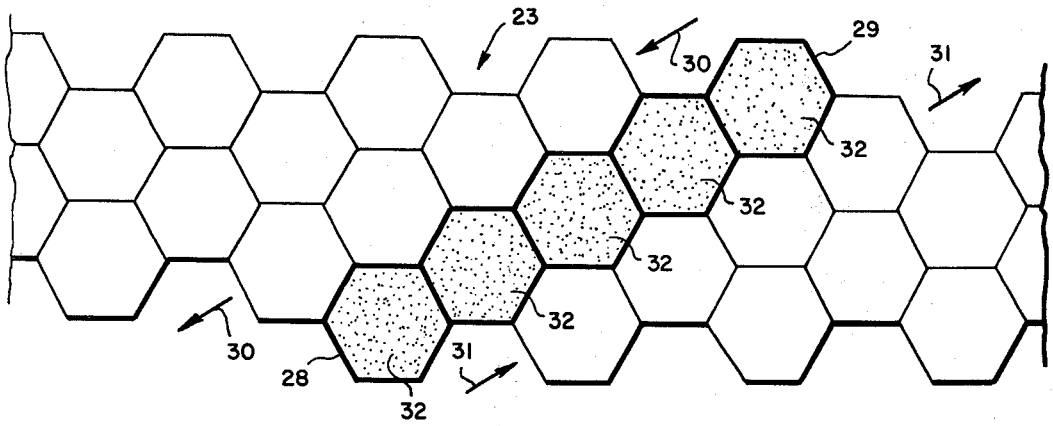
FIG. 10 is a schematic layout of a portion of the honeycomb structure formed into a helical stack as shown in FIG. 3.

Referring now to FIG. 10, there is shown a portion of the helical stack of FIG. 3 reproduced in a laid-out configuration. It will be noted that the initial end of the corrugated strip is shown at 28 while the terminal end of the corrugated strip is shown at 29. Only a few successive helical turns are depicted for purposes of clarity. Regardless of the number of turns making up the helical stack, however, there will always be an initial end, such as indicated at 28 and a terminal end as indicated at 29, these respective ends resulting in an unevenness of the opposite ends of the resulting cylindrical structure. In other words, the top and bottom ends of the cylinder do not lie in parallel planes but rather are skewed very slightly as a consequence of the initial end 28 and the terminal end 29.

It is possible to "flatten" the oppose ends of the cylindrical configurations so that the same will lie in flat planes, parallel to each other and normal to the axis of the cylinder. This flattening is achieved by providing skewed coupling forces on the cylinder described in FIG. 3. Such a skewed coupling force will result in an angulated pulling force on the portion of honeycomb cells depicted in FIG. 2 in the direction of the arrows 30 and 31. These forces are in opposite directions as indicated by the arrows 30 and 31, so that the "skewed coupling" force is applied to transform the one diagonal row of honeycomb cells between the initial and terminal ends 28 and 29 indicated by the shaded areas in FIG. 10 at 32.

Figure 11:
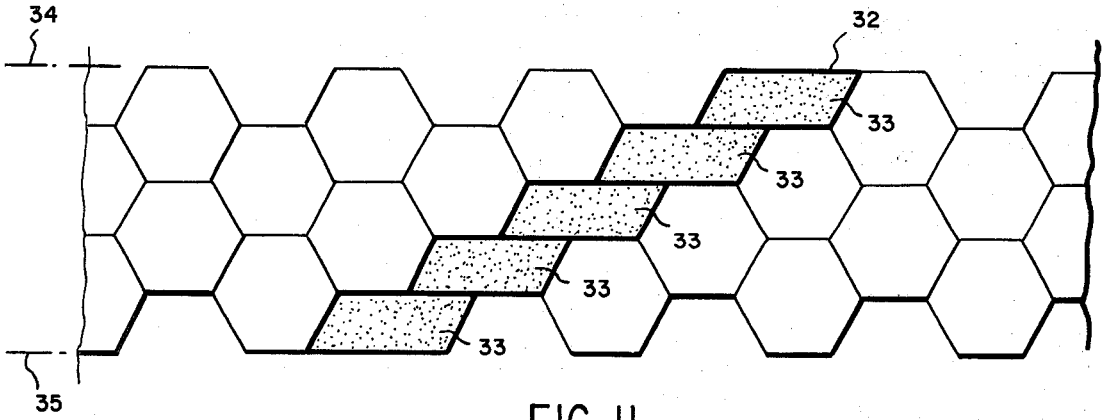
FIG. 11 is a view similar to FIG. 10 but illustrating the relative positions of the honeycomb cells after a circumferential expansion force has been applied; and, FIG. 12 is a perspective view of a completed honeycomb cylinder in accord with the present invention wherein an outer skin is being applied.

When a sufficient coupling force has been exerted, as in the direction of the arrows 30 and 31 in FIG. 10, the diagonal row of honeycomb cells will be transformed into elongated parallelograms, as indicated at 33 in FIG. 11. It will be noted, as a consequence of the transformation, that now the top and bottom of the cylindrical structure line in parallel planes normal to the axis of the cylinder. These planes are schematically depicted by the dashed lines 34 and 35 respectively, in FIG. 11.

Figure 12:
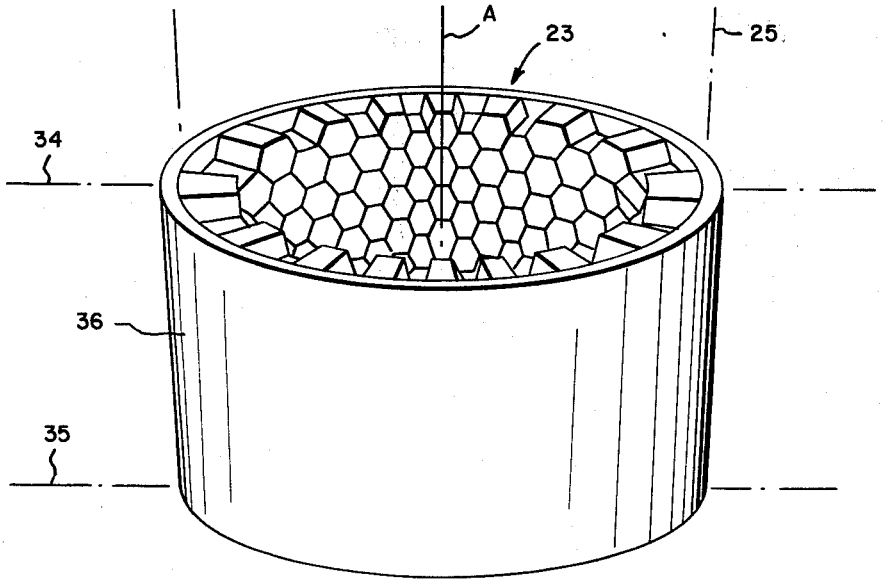

FIG. 12 shows a final step in the completion of a honeycomb cylinder in accord with the present invention wherein an outer skin 36 is applied to the outer wall of the honeycomb structure. In some cases, an inner skin may also be applied. As described with respect to FIG. 3, the lateral wall of the honeycomb structure in a vertical direction parallel to the axis A is absolutely rectilinear as indicated by the line 25. The avoidance of any bowing inwardly of the honeycomb structure as characterized the prior art and as mentioned heretofore avoids the generation of undue stresses and the like in the various nodal connections of the honeycombs and the attachment of the outer and inner skin, if an inner skin is applied.

From all of the foregoing, it will thus be evident that the present invention has provided a greatly improved method of manufacturing honeycomb structures and a greatly improved resulting product.

While the method chosen for illustrative purposes involved corrugating a ribbon strip, while following a straight path, such that the corrugations resulted in opposite longitudinal edges following wave forms of different amplitude, it should be understood that the corrugating wheels as described in FIG. 3 can be designed to corrugate the ribbon in a manner so that it emerges from between the wheels to follow a curved path and wherein the opposite longitudinal edges would then be of equal height. In other words, the curving of the corrugated strip can be accomplished simultaneously with the forming of the corrugations. Such a curved strip exiting from the corrugation wheels, if then straightened, would have one longitudinal edge of a height greater than the opposite longitudinal edge.

This invention, accordingly, is not to be thought of as limited by the specific examples set forth and illustrated.

We claim:

1. A honeycomb manufacturing method including the steps of:

(a) corrugating a ribbon of honeycomb core material so that one longitudinal edge defines a first repetitive wave form of a first amplitude when viewing the ribbon when straight from one side and the opposite longitudinal edge defines a second repetitive wave form of a second amplitude, less than said first amplitude, when viewing the ribbon when straight from the opposite side so that when the one side and opposite side are curved in a manner to stretch the one side and compress the opposite side, said first and second amplitudes can be equalized for a given radius of curvature; and (b) stacking and welding together a plurality of such curved ribbons of core material to form a cylindrical honeycomb structure in which the lateral wall in a direction parallel to the axis of the cylindrical structure is rectilinear and wherein the planes of the nodes of the honeycomb structure are normal to said axis.

2. A honeycomb manufacturing method including the steps of:

(a) corrugating a ribbon of honeycomb core material in a continuous manner as it moves along a path so that one longitudinal edge defines a first truncated triangular wave form when viewing the ribbon from one side and the opposite longitudinal edge defines a second truncated triangular wave form when viewing the ribbon from the opposite side, the height of the first truncated triangular wave form being greater than the height of the second truncated triangular wave form so long as the path is straight;

(b) inserting brazing material on the corrugated ribbon;

(c) guiding the path of movement of the core material with brazing material into an helical stack with the brazing material between successive helical turns; and (d) welding the helical turns of the core material together so that a cylinder of honeycomb material results, the outside wall of the cylinder being made up of said one longitudinal edge of the core material and the inside wall being made up of said opposite longitudinal edge of the core material, the radius of the cylinder being such that resulting stretching of the one longitudinal edge and compressing of the opposite longitudinal edge equalizes the said heights of the first truncated triangular and second truncated triangular wave forms respectively defined by the edges so that the lateral wall of the cylinder is rectilinear in a direction parallel to the axis of the cylinder and the planes of the nodes of the honeycomb material are normal to said axis.

3. The method of claim 2, including the additional step of providing skewed coupling forces on said cylinder to transform one diagonal row of honeycomb cells extending between the initial and terminal ends of the helical ribbon of core material into elongated parallelograms whereby the top and bottom ends of the cylinder lie in parallel planes perpendicular to the axis of the cylinder.

4. The method of claim 2, including the step of brazing an outer skin material to the outer wall of the cylinder, made up of the one longitudinal edge.

* * * * *